US008146782B2

(12) United States Patent
Gross et al.

(10) Patent No.: US 8,146,782 B2
(45) Date of Patent: Apr. 3, 2012

(54) FOAM HEAD, AND FOAM HEAD WITH A PROPELLANT CONTAINER

(75) Inventors: Maria Gross, Pfungstadt (DE); Harald Lohnes, Brombachtal (DE); Gabriele Stolper, Rossdorf (DE)

(73) Assignee: Wella GmbH, Schwalbach am Taunus (DE)

( * ) Notice: Subject to any disclaimer, the term of this patent is extended or adjusted under 35 U.S.C. 154(b) by 818 days.

(21) Appl. No.: 10/581,010

(22) PCT Filed: Dec. 6, 2004

(86) PCT No.: PCT/EP2004/013851

§ 371 (c)(1),
(2), (4) Date: Feb. 16, 2007

(87) PCT Pub. No.: WO2005/054083

PCT Pub. Date: Jun. 16, 2005

(65) Prior Publication Data

US 2007/0267448 A1 Nov. 22, 2007

(30) Foreign Application Priority Data

Dec. 6, 2003 (DE) ..... 103 57 179

(51) Int. Cl.
*B65D 83/00* (2006.01)

(52) U.S. Cl. ..... 222/402.13; 222/402.1; 222/402.21

(58) Field of Classification Search ..... 222/402.13, 222/402.15, 402.21, 402.1; D9/448; 239/577, 239/579

See application file for complete search history.

(56) References Cited

U.S. PATENT DOCUMENTS

| | | | | | |
|---|---|---|---|---|---|
| 2,631,814 | A | * | 3/1953 | Abplanalp | 251/353 |
| 2,913,749 | A | | 11/1959 | Ayres | |
| 2,981,446 | A | * | 4/1961 | Campbell | 222/402.13 |
| 3,095,122 | A | * | 6/1963 | Lewiecki et al. | 222/146.3 |
| 3,096,002 | A | * | 7/1963 | Focht | 222/402.15 |
| 3,101,876 | A | * | 8/1963 | Ayres | 222/402.13 |
| 3,112,048 | A | * | 11/1963 | Finkenzeller | 222/402.13 |
| 3,156,382 | A | * | 11/1964 | Michell | 222/402.13 |
| 3,690,519 | A | * | 9/1972 | Wassilieff et al. | 222/402.13 |
| 3,865,283 | A | * | 2/1975 | Hayes | 222/402.11 |
| 3,884,399 | A | * | 5/1975 | Matern | 222/402.13 |
| 3,920,165 | A | * | 11/1975 | Schultz | 222/402.23 |
| 4,420,099 | A | * | 12/1983 | Pizzurro et al. | 222/205 |
| 5,139,201 | A | | 8/1992 | De Laforcade et al. | |
| 5,762,322 | A | * | 6/1998 | Smith | 222/402.11 |

FOREIGN PATENT DOCUMENTS

| | | |
|---|---|---|
| EP | 0 792 821 | 9/1997 |
| GB | 951 101 | 3/1964 |
| JP | 09 031464 | 11/1997 |
| JP | 2000 007062 | 1/2000 |

* cited by examiner

*Primary Examiner* — Kevin P Shaver
*Assistant Examiner* — Daniel R Shearer
(74) *Attorney, Agent, or Firm* — Michael J. Striker

(57) ABSTRACT

Disclosed is a foam head (1) for a propellant container (2) with an inner and an outer crimped edge (3, 4) of a valve disk (5). Said foam head (1) comprises an actuating button (6) and a foam discharge port (7) and is embodied so as to sit directly on a valve stem (8). A bottom section (9) of the foam head (1) has an outer diameter (10) that is approximately identical to an inner diameter (11) of the inner crimped edge (3). An outer rib (13) which faces the actuating button (6) is disposed in a lower area (12) of the bottom section (9) so as to engage underneath a bottom side (14) of the inner crimped edge (3). A lower edge (15) of the bottom section (9) is provided with at least one recess (16) in order to form an annular spring (17).

4 Claims, 5 Drawing Sheets

FOAM HEAD, AND FOAM HEAD WITH A PROPELLANT CONTAINER

BACKGROUND OF THE INVENTION

The invention relates to a foam head and to a foam head having a propellant container.

A foam head of this generic type made of plastic as a mass-produced article is known for instance from European Patent Disclosure EP 0792821 A1, which for securing purposes is connected to an outer crimped edge of a propellant container.

SUMMARY OF THE INVENTION

By comparison, the first object of the invention is to create a foam head which by simple provisions attains substantial savings in material consumption. The second, coordinate object of the invention is to create a foam head having a propellant container, which by simple provisions achieves a substantial savings in material consumption, and in which by simple provisions, the propellant container can be used for further purposes.

BRIEF DESCRIPTION OF THE DRAWINGS

The invention will now be described in further detail in terms of two exemplary embodiments.

Shown are.

DETAILED DESCRIPTION OF THE PREFERRED EMBODIMENTS

Figure 1:
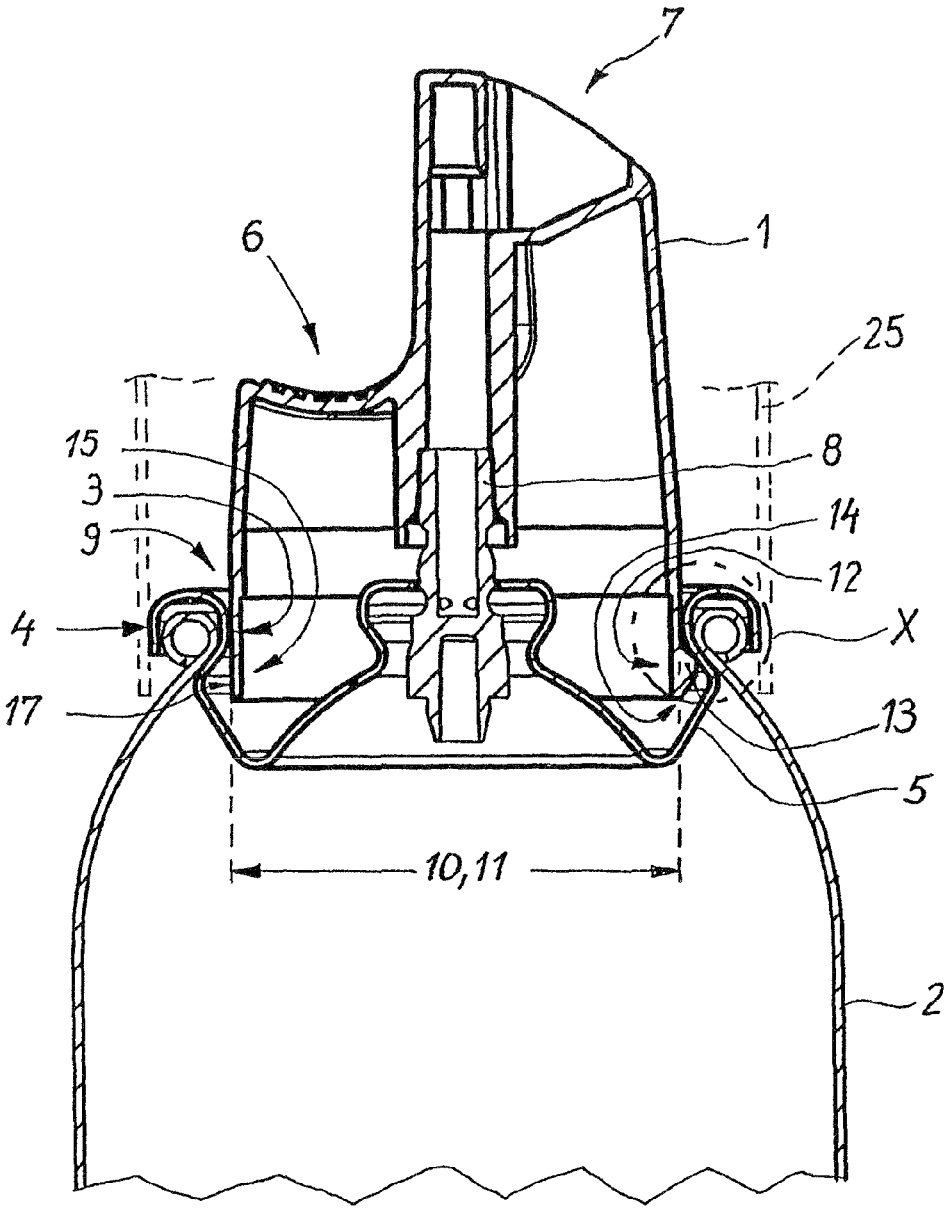
FIG. 1, in an axial sectional view, a first exemplary embodiment of an unactuated foam head, which is connected to a propellant container.
Figure 3:
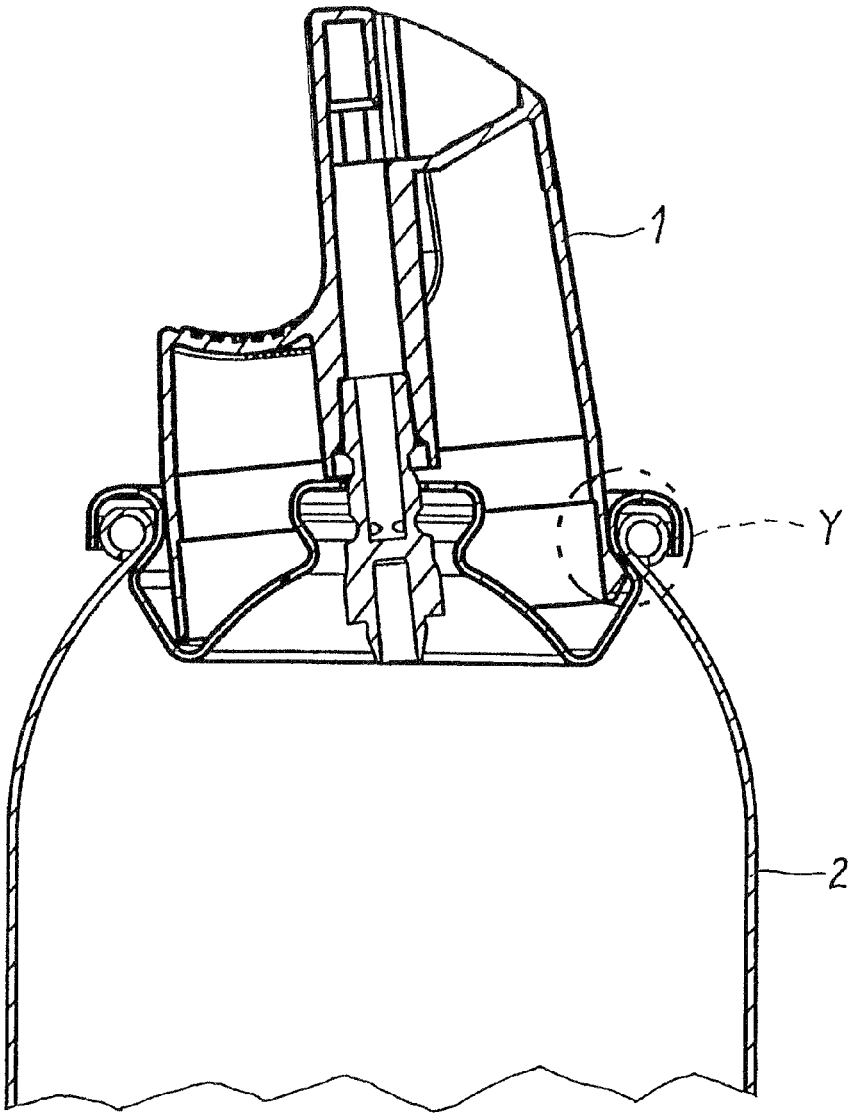
FIG. 3, an axial sectional view as in FIG. 1, but in an actuated state.

FIG. 1 shows, as the first exemplary embodiment, a foam head 1 for a propellant container 2, having one inner and one outer crimped edge 3, 4 of a valve plate 5, in which the foam head 1 having an actuation button 6 and a foam dispensing opening 7 is embodied as seatable directly on a valve stem 8. A lower portion 9 of the foam head 1 has approximately the same outer diameter 10 as an inner diameter 11 of the inner crimped edge 3, and the lower portion 9 of the foam head 1 can also be tilted as shown in FIG. 3 inside the inner crimped edge 3. In a lower region 12 of the lower portion 9, diametrically opposite the actuation button 6, there is an outer rib 13 for engaging a lower side 14 of the inner crimped edge 3 from below. For the sake of forming an annular spring 17, a lower edge 15 of the lower portion 9 is provided with at least one recess 16. It is thus assured that the foam head 1 can be actuated and remains joined to the propellant container 2 and cannot fall off. The restoring force after the actuation of the actuation button 6 for applying a partial amount of foam is provided by the resilient valve stem.

The foam head 1, to prevent unintentional actuation, can be provided with a guard cap 25, shown in dashed lines, which is joined to the outer crimped edge 4 in such a way that it can be detached again.

Figure 2:
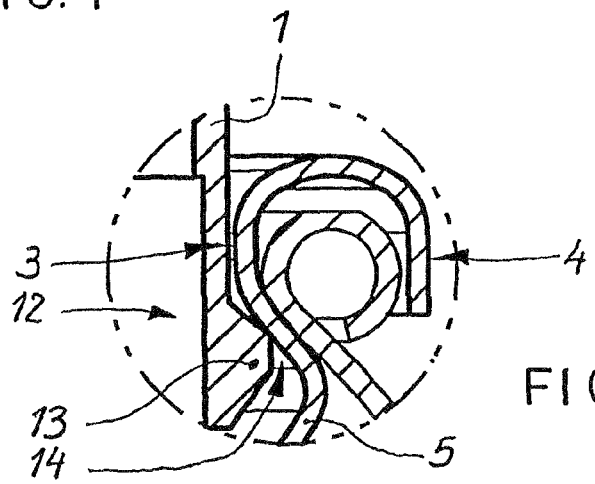
FIG. 2, a detail X in FIG. 1.

FIG. 2 shows a detail X in FIG. 1.

FIG. 3 shows an axial sectional view as in FIG. 1, but in a state in which it is actuated with the actuation button 6. From this, tilting of the outer rib 13 on the lower side 14 of the inner crimped edge 3 is clearly visible.

Figure 4:
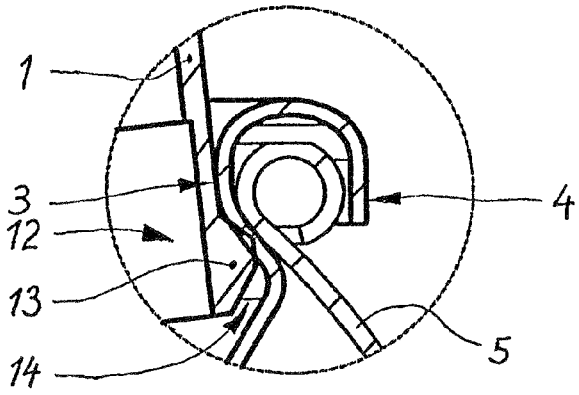
FIG. 4, a detail Y in FIG. 3.

FIG. 4 shows a detail Y in FIG. 3.

Figure 5:
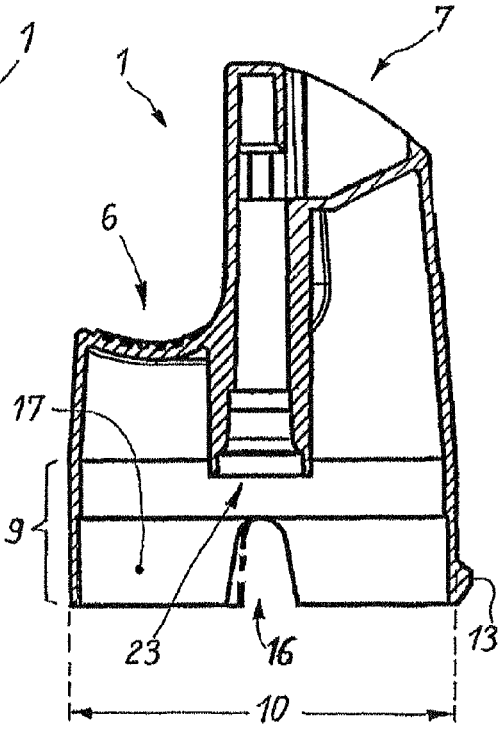
FIG. 5, a foam head of FIG. 1, by itself.

FIG. 5 shows a foam head of FIG. 1 by itself; it has a receptacle 23 for the valve stem 8.

Figure 6:
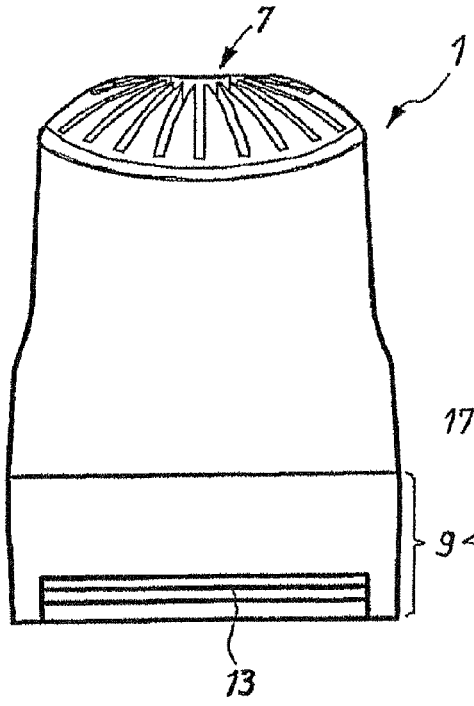
FIG. 6, the foam head of FIG. 5 in a side view.

FIG. 6 shows the foam head 1 of FIG. 5 in a side view.

Figure 7:
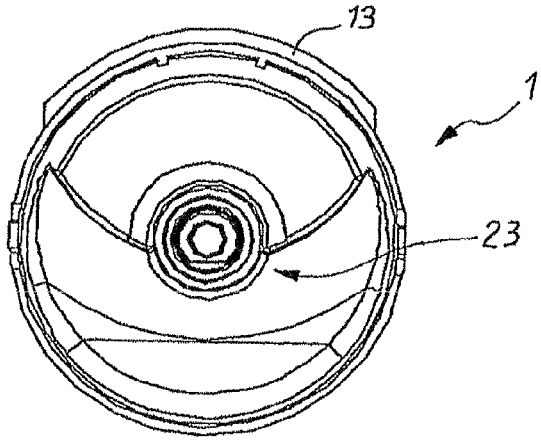
FIG. 7, the foam head of FIG. 6 in a view from below.

FIG. 7 shows the foam head 1 of FIG. 6 in a view from below.

Figure 8:
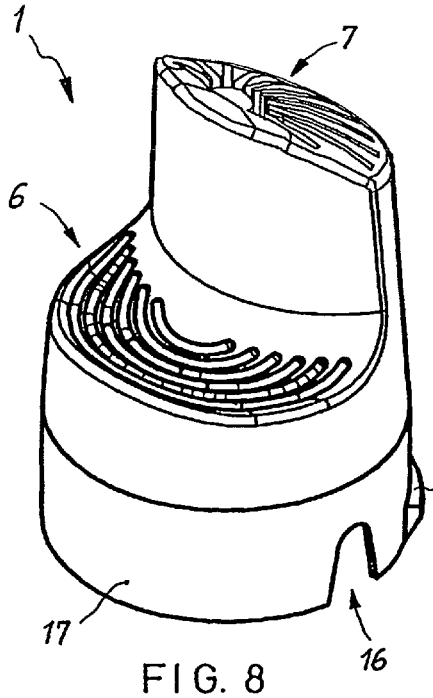
FIGS. 8 and 9, in different perspective views, the foam head of FIG. 6.
Figure 9:
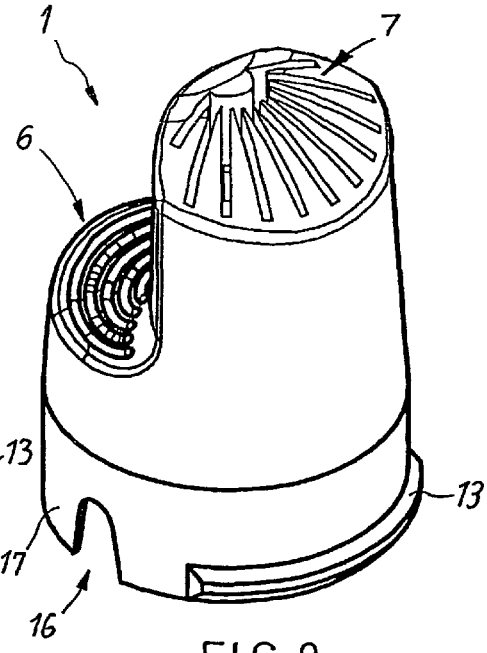

FIGS. 8 and 9, for further illustration, show the foam head 1 of FIG. 6 in different perspective views.

Figure 10:
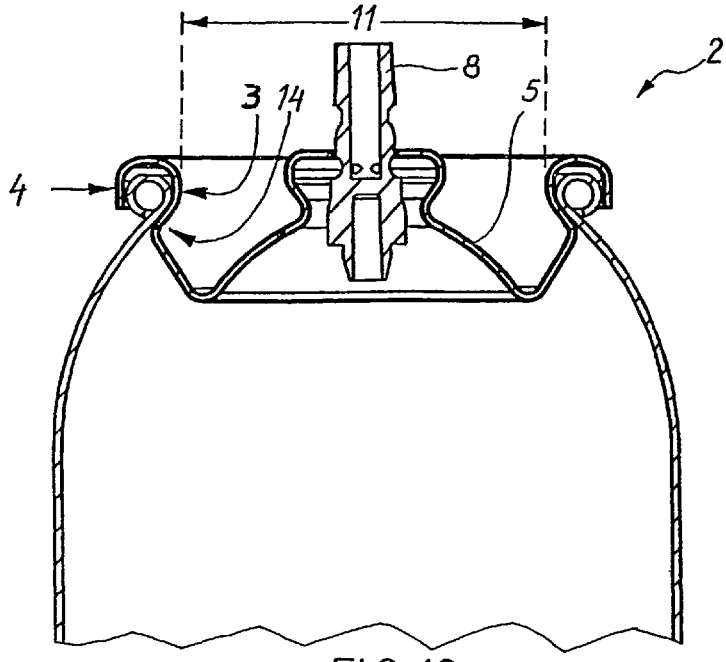
FIG. 10, in an axial sectional view, a propellant container without a foam head.

FIG. 10 shows in an axial sectional view, a propellant container 2 without a foam head 1.

Figures 11, 12:
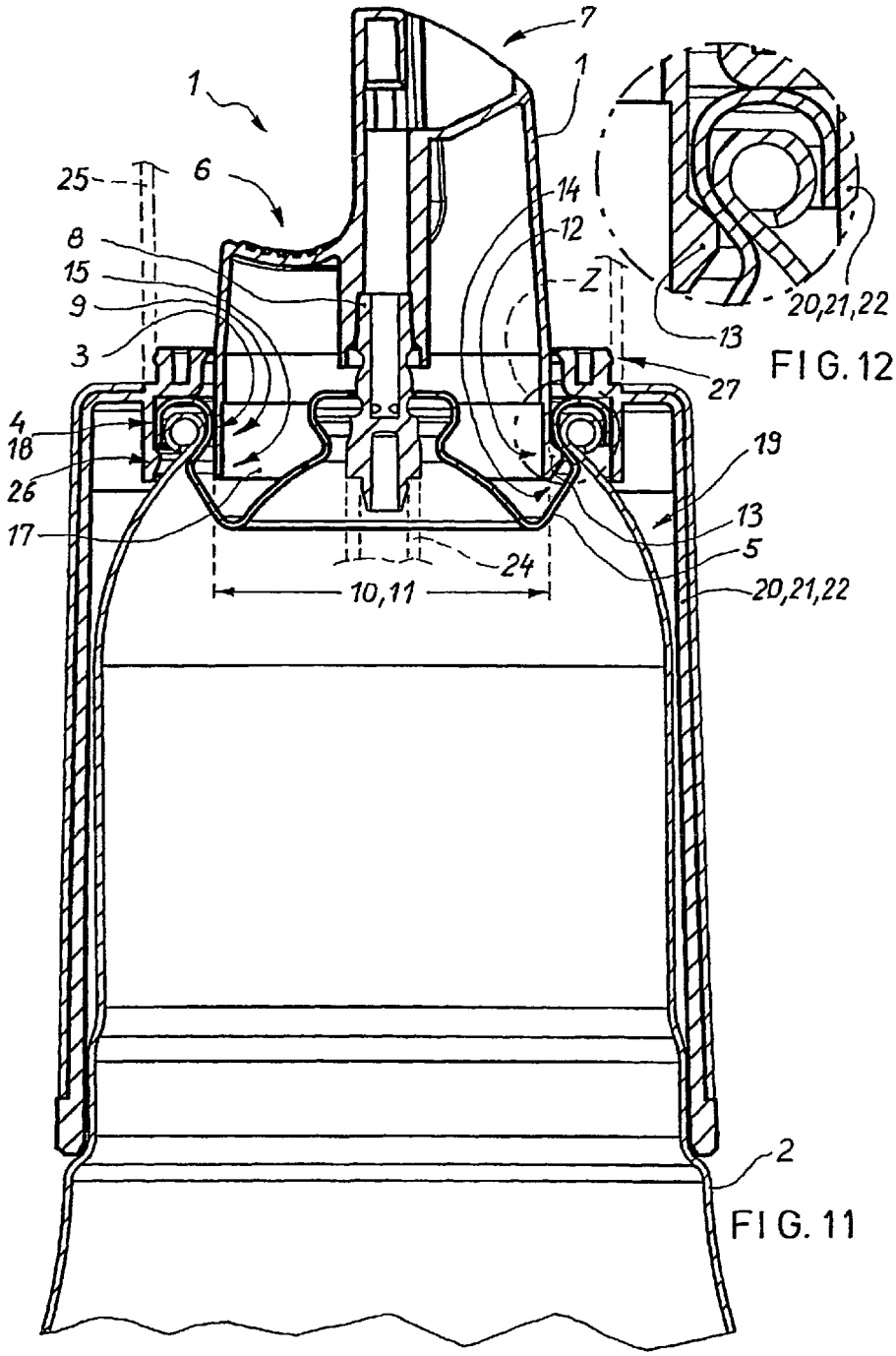
FIG. 11, in an axial sectional view, a second exemplary embodiment of an unactuated foam head, which is connected to a propellant container and which is connected to a sleeve at the outer crimped edge.
FIG. 12, a detail Z in FIG. 11.

FIG. 11 shows, as the second exemplary embodiment, a foam head 1 having a propellant container 2, having one inner and one outer crimped edge 3, 4, of a valve plate 5, in which the foam head 1 having an actuation button 6 and a foam dispensing opening 7*y* is embodied as seatable directly on a valve stem 8; a lower portion 9 of the foam head 1 has approximately the same outer diameter 10 as an inner diameter 11 of the inner crimped edge 3. In a lower region 12 of the lower portion 9, diametrically opposite the actuation button 6, there is an outer rib 13 for engaging a lower side 14 of the inner crimped edge 3 from below. For the sake of forming an annular spring 17, a lower edge 15 of the lower portion 9 is provided with at least one recess 16. It is thus assured that the foam head 1 can be actuated and remains joined to the propellant container 2 and cannot fall off. The restoring force after the actuation of the actuation button 6 for applying a partial amount of foam is provided by the resilient valve stem. This second exemplary embodiment differs from the first exemplary embodiment of FIG. 1 essentially in that that outer crimped edge 4 is intended as a connecting seat 18 of a sleeve 20 sheathing at least the upper region 19 of the propellant container 2, and the sleeve 20 is joined to the outer crimped edge 4 by a snap ring 26. The sleeve 20 is embodied as a graspable part, making manipulation easier during application, especially if the graspable part 21 is embodied as slip-proof. The sleeve 20 can selectively be designed as a decorative part 22, for instance by means of a special coloring and/or imprint, for instance for providing additional information on the foam product. A haircare product, for instance, can be intended as the foam product.

The foam head 1, to prevent unintentional actuation, can be provided with a guard cap 25 (FIG. 11) shown in dashed lines, which is joined detachably to a clamping bead 27 above the sleeve 20, and the outer diameter of the clamping bead 27 is equivalent to the outer diameter of the crimped edge 4, making it possible to use commercially available guard caps 25.

FIG. 12 shows a detail Z in FIG. 11.

A secure tilting seat of the foam head 1 is assured by a collaboration of the annular spring 17, because of the spring action of the outer diameter 10 and the recess 16, with the outer rib 13 on one side, which catches below the inner, lower crimped edge 14. Manual pressure by a finger on the actuation button 6 of the foam head 1 causes the foam head 1 to tilt and the valve stem 8 to be activated. Two-finger actuation (by means of two diametrically opposed actuation faces) is also possible, given a suitably modified construction, but in that case the annular spring 17 has only a retention function and does not reinforce the tilting action.

The foam dispensing opening 7 on the foam head 1 is provided here for upside-down application (with the foam head 1 at the bottom), but it is also possible—as with the first exemplary embodiment of FIG. 1 also—for a horizontal application or one with the foam head 1 pointing upward to be provided; in that case, a corresponding (elastic) riser pipe 24 (shown in dashed lines) is joined to the lower part of the valve stem 8 and extends as far as the bottom (not seen) of the propellant container 2.

The foam head 1, to prevent unintentional actuation, can be provided with a guard cap 25 (FIG. 1) shown in dashed lines, which is joined to the outer crimped edge 4 in such a way that it can be detached again.

Mounting the foam head 1 on the valve stem 8 is done using high-speed systems (sliding seat on the valve stem 8 and face-end sealing upon actuation).

Because of the invention, a savings of material and cost reduction of approximately 50% is possible, compared with positional securing via the outer diameter 10 of the valve as in the prior art.

LIST OF REFERENCE NUMERALS

1 Foam head
2 Propellant container
3 Inner crimped edge
4 Outer crimped edge
5 Valve plate
6 Actuation button
7 Foam dispensing opening
8 Valve stem
9 Lower portion of the foam head 1
10 Outer diameter
11 Inner diameter
12 Lower region of the lower portion 9
13 Outer rib
14 Lower side of the inner crimped edge 3
15 Lower peripheral region of the lower portion 9
16 Recess
17 Annular spring
18 Connecting seat
19 Upper region of the propellant container 2
20 Sleeve
21 Graspable part
22 Decorative part
23 Receptacle
24 Riser pipe
25 Guard cap
26 Snap ring
27 Clamping bead

The invention claimed is:

1. A foam head for a propellant container which has a valve plate having inner and outer crimped edges and a valve stem supported by the valve plate and having an axis extending along the valve stem, and a foam dispensing opening that opens out into a receptacle seated directly on the valve stem and resiliently biased so that in an assembled state, said valve stem applies a restoring force in a direction of said axis, the foam head comprising an actuation button located at one side of said axis; a lower portion having an outer diameter approximately equal to an inner diameter of the inner crimped edge; an outer rib located in a lower region of the lower portion at a diametrically opposite side of said axis with respect to a location of the actuation button for engagement from beneath of a lower side of the inner crimped edge, and wherein a lower peripheral region of the lower portion has at least one recess located between said actuation button and said outer rib if projected onto an imaginary plane including the axis and extending through the locations of the actuation button and the outer rib and forming an annular spring which provides an effective restoration force to the foam head by interaction with an inward facing surface of the valve plate during operation, wherein said foam head is configured such that upon actuation of said foam head, said foam head remains joined to said propellant container and is incapable of undesired removal from said propellant container.

2. A combination of a foam head with a propellant container, wherein the propellant container has a valve plate having an inner and outer crimped edge and a valve stem supported by the valve plate and having an axis extending along the valve stem; and a foam dispensing opening which opens out into a receptacle seated directly on the valve stem, wherein said valve stem is a resiliently biased and applies a restoring force in a direction of said axis for applying a partial amount of foam, and wherein the foam head has an actuation button located at one side of said axis, a lower portion having an outer diameter approximately equal to an inner diameter of the inner crimped edge, and an outer rib located in a lower region of the lower portion at a diametrically opposite side of said axis with respect to a location of the actuation button for engagement from beneath of a lower side of the inner crimped edge, and wherein a lower peripheral region of the lower portion has at least one recess located between said actuation button and said outer rib if projected onto an imaginary plane including the axis and extending through the locations of the actuation button and the outer rib and forming an annular spring which provides an effective restoration force to the foam head by interaction with an inward facing surface of the valve plate during operation, and a sleeve is located at least in an upper region of the propellant container, wherein the outer crimped edge is a connecting seat of said sleeve, wherein said foam head is configured, such that upon actuation of said foam head, said foam head remains joined to said propellant container and is incapable of undesired removal from said propellant container.

3. The combination of the foam head with the propellant container as defined by claim 2, wherein the sleeve is a graspable part.

4. The combination of the foam head with the propellant container as defined by claim 2, further comprising a guard cap, wherein an upper part of the sleeve is provided with a clamping bead for mounting the guard cap in such a way that it can be released again, and an outer diameter of the clamping bead is equal to an outer diameter of the crimped edge.

* * * * *